United States Patent [19]

Webb

[11] 4,023,847

[45] May 17, 1977

[54] OVERSHOT TOOL

[75] Inventor: Derrel D. Webb, Houston, Tex.

[73] Assignee: Houston Engineers, Inc., Tex.

[22] Filed: Aug. 20, 1975

[21] Appl. No.: 606,304

[52] U.S. Cl. ..... 294/86.3

[51] Int. Cl.[2] ..... E21B 31/02

[58] Field of Search ..... 294/86.1, 86.17, 86.18, 294/86.26, 86.27, 86.28, 86.3, 86.31, 86.33, 90; 166/98, 97, 315

[56] References Cited

UNITED STATES PATENTS

| | | | |
|---|---|---|---|
| 2,491,392 | 12/1949 | Osman | 294/86.3 |
| 2,689,763 | 9/1954 | Osman | 294/86.17 |
| 2,743,130 | 4/1956 | Osman | 294/86.17 |
| 2,945,720 | 7/1960 | Osman | 294/86.3 |
| 2,970,859 | 2/1961 | Justice | 294/86.17 |
| 3,667,795 | 6/1972 | Gray | 294/86.17 |

*Primary Examiner*—James B. Marbert
*Attorney, Agent, or Firm*—W. F. Hyer; Marvin B. Eickenroht

[57] ABSTRACT

An overshot tool having a cylindrical grapple seated within the bowl of a tubular body, each of the grapple and bowl having longitudinal slots extending from each end thereof, and tangs being carried within the body and extending into the slots to limit rotation of the grapple with respect to the body.

7 Claims, 5 Drawing Figures

Figure 1:
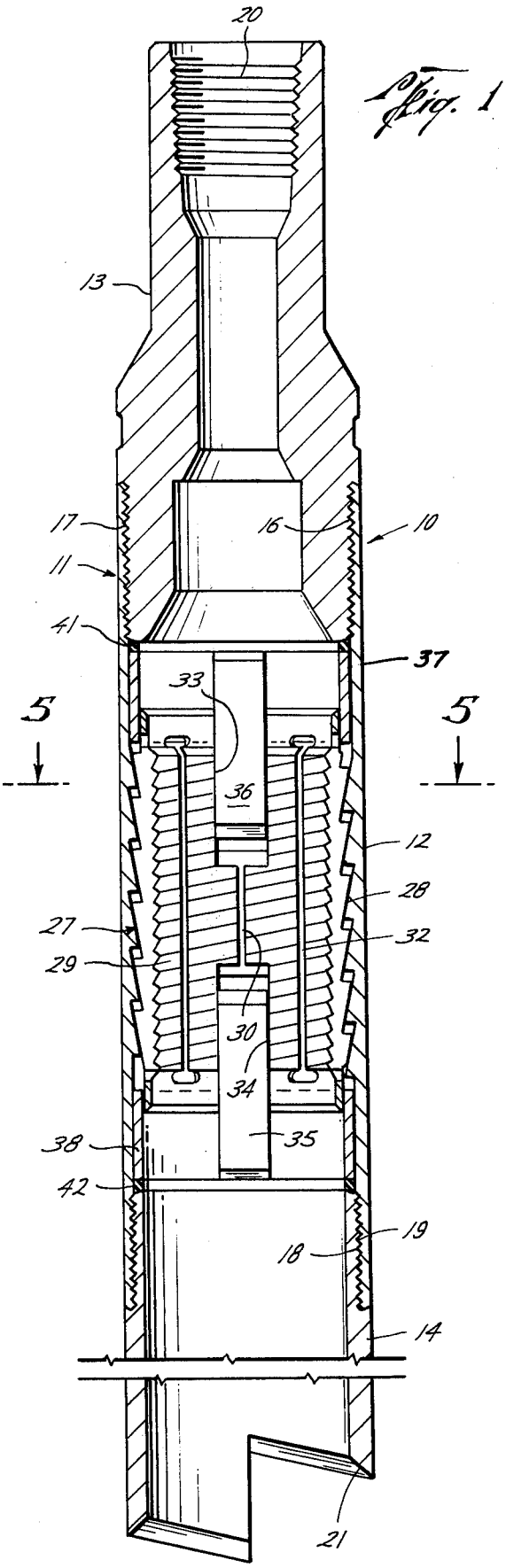
Figure 2:
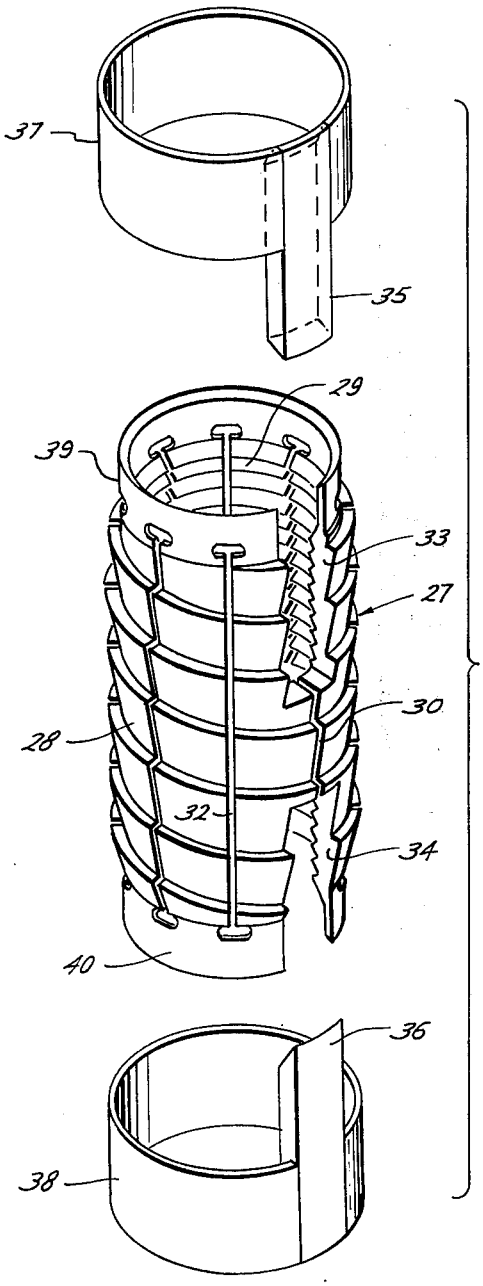

Fig. 3
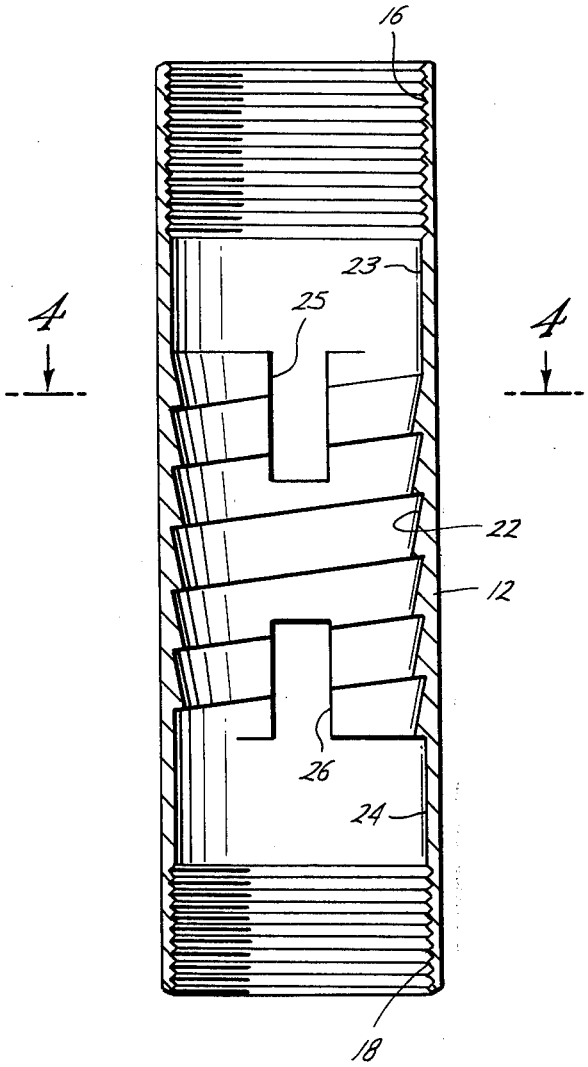
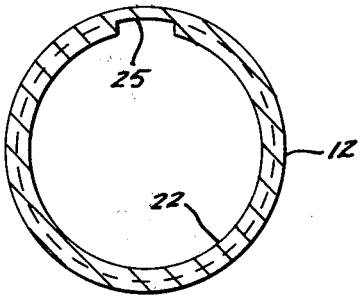
Fig. 4
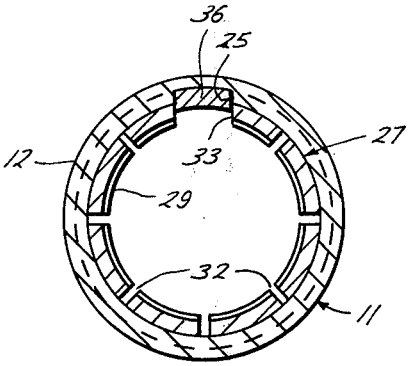
Fig. 5 the ledges at the lower ends of the tapered surfaces 22. Thus, as will be understood from the description to follow, the grapple is free to move upwardly as it is expanded outwardly in order to move into gripping engagement about the object over which the lower end of the tool is moved.

Teeth 29 are arranged spirally about the inner diameter of the grapple, and the grapple is split longitudinally at 30 so as to permit it to expand and contract. Thus, the grapple 27 will be so selected that the inner diameter of its teeth 29 is just less than the outer diameter of the object to be recovered so that as the tool is lowered onto the object, the lower end of the grapple will expand outwardly a sufficient extent to permit the teeth 29 to be moved downwardly over the object. As previously described, during this outward expansion of the grapple, it is free to move upwardly within the bowl a limited extent. Then, when the grapple is disposed about a desired vertical extent of the object, the tool may be lifted by raising of the pipe string to cause the grapple to wedge tightly about the object as its surfaces 28 slide downwardly over surfaces 22. As illustrated, the grapple is preferably provided with longitudinal slits 32 extending substantially from one end to the other of its cylindrical body so as to facilitate expansion and contraction.

As previously mentioned, in the event the object is stuck in the well bore and cannot be lifted with the tool, it's necessary to release the tool from the object for removal from the well bore. For this purpose, the upper and lower ends of the grapple body are provided with slots 33 and 34, respectively, of substantially the same width and longitudinal extent as the slots 25 and 26 in the bowl. During assembly within the bowl, the grapple is rotated to a position in which its slots are aligned with those of the bowl, and upper and lower tangs 35 and 36 carried within the body extend into the aligned slots to limit rotation of the grapple with respect to the bowl. Thus, as indicated in FIG. 5, the tangs are somewhat thicker than the slots in the bowl so as to bridge the separation between the bowl and grapple so as to transmit torque to the grapple upon rotation of the pipe string. More particularly, the ends of the tangs are spaced from the ends of the slots in which they are received to permit limited vertical movement of the grapple within the bowl, and the sides of the tangs fit closely within the sides of the slots.

The tangs are carried within the bowl by means of rings 37 and 38 which are mounted closely within the cylindrical portions of the bowl above and below tapered surfaces 22. Thus, tang 35 is carried by ring 37 which extends vertically between the lower end of upper body portion 13 and the uppermost surface 22 of bowl 12, and tang 36 is carried by tang 38 which is seated above the upper end of lower tubular portion 14 and extends upwardly to the lowermost surface 22 of the bowl.

The lower end of tang 37 fits about a reduced neck 39 at the upper end of the grapple body, and the upper end of tang 38 fits about a reduced neck 40 at the lower end of the grapple body. A seal ring 41 is held between the lower end of portion 13 and the upper end of ring 37, and a seal ring 42 is held between the upper end of portion 14 and the lower end of ring 38.

In the assembly of tool 10, grapple 27 is first installed within bowl 12, as previously described. Tangs 35 and 36 are then moved into their respective slots, the rings 37 and 38 fitting into spaces between the bowl and the necks on the ends of the grapple. Seal rings 41 and 42 are then moved into positions adjacent the ends of the rings, and tubular portions 13 and 14 threadedly made up with the ends of the bowl.

From the foregoing it will be seen that this invention is one well adapted to attain all of the ends and objects hereinabove set forth, together with other advantages which are obvious and which are inherent to the apparatus. p It will be understood that certain features and subcombinations are of utility and may be employed without reference to other features and subcombinations. This is contemplated by and is within the scope of the claims.

As many possible embodiments may be made of the present invention without departing from the scope thereof, it is to be understood that all matter herein set forth or shown in the accompanying drawings is to be interpreted as illustrative and not in a limiting sense.

The invention having been described, what is claimed is:

1. An overshot tool for use in recovering an object from a well bore, comprising a tubular body having an upper end adapted to be connected to the lower end of a pipe string so that the body may be raised and lowered within the well bore, a lower end adapted to move over the object as the body is so lowered, and downwardly and inwardly tapered surfaces on its inner diameter intermediate its upper and lower ends, a cylindrical grapple having downwardly and inwardly tapered surfaces on its outer diameter adapted to seat upon the tapered surfaces of the body, and spirally arranged teeth on its inner diameter, said grapple being split longitudinally and free to move upwardly within the body so as to permit it to expand outwardly for gripping an object of greater diameter than the teeth as the lower end of the body is moved over said object, each of the body and grapple having longitudinal slots extending from each end thereof, and means including tangs carried within the body and extending into the slots in the body and grapple so as to limit rotation of said grapple with respect to the body, as the body is rotated with said pipe string, in order that said teeth may be backed off of said object.

2. A tool of the character defined in claim 1, wherein the tangs are mounted on rings carried within the body above and below the tapered surfaces thereon.

3. A bowl for use in an overshot tool, comprising a tubular member having threads at its opposite ends, downwardly and inwardly tapered surfaces on its inner diameter intermediate its opposite ends, and a slot extending into each end of the tapered surfaces.

4. A bowl of the character defined in claim 3, wherein said tapered surfaces are arranged spirally, and at least one end of the bowl has an inner diameter larger than that of the seating surfaces.

5. A grapple, comprising a cylindrical body having downwardly and inwardly tapered surfaces on its outer diameter, spirally arranged teeth on its inner diameter, and a slot extending into each end of the tapered surfaces.

6. A grapple of the character defined in claim 5, wherein there is a longitudinal split in the body extending from one slot to the other.

7. A grapple of the character defined in claim 5, wherein the tapered surfaces are arranged spirally.

* * * * * the ledges at the lower ends of the tapered surfaces 22. Thus, as will be understood from the description to follow, the grapple is free to move upwardly as it is expanded outwardly in order to move into gripping engagement about the object over which the lower end of the tool is moved.

Teeth 29 are arranged spirally about the inner diameter of the grapple, and the grapple is split longitudinally at 30 so as to permit it to expand and contract. Thus, the grapple 27 will be so selected that the inner diameter of its teeth 29 is just less than the outer diameter of the object to be recovered so that as the tool is lowered onto the object, the lower end of the grapple will expand outwardly a sufficient extent to permit the teeth 29 to be moved downwardly over the object. As previously described, during this outward expansion of the grapple, it is free to move upwardly within the bowl a limited extent. Then, when the grapple is disposed about a desired vertical extent of the object, the tool may be lifted by raising of the pipe string to cause the grapple to wedge tightly about the object as its surfaces 28 slide downwardly over surfaces 22. As illustrated, the grapple is preferably provided with longitudinal slits 32 extending substantially from one end to the other of its cylindrical body so as to facilitate expansion and contraction.

As previously mentioned, in the event the object is stuck in the well bore and cannot be lifted with the tool, it's necessary to release the tool from the object for removal from the well bore. For this purpose, the upper and lower ends of the grapple body are provided with slots 33 and 34, respectively, of substantially the same width and longitudinal extent as the slots 25 and 26 in the bowl. During assembly within the bowl, the grapple is rotated to a position in which its slots are aligned with those of the bowl, and upper and lower tangs 35 and 36 carried within the body extend into the aligned slots to limit rotation of the grapple with respect to the bowl. Thus, as indicated in FIG. 5, the tangs are somewhat thicker than the slots in the bowl so as to bridge the 37 and 38 fitting into spaces between the bowl and the necks on the ends of the grapple. Seal rings 41 and 42 are then moved into positions adjacent the ends of the rings, and tubular portions 13 and 14 threadedly made up with the ends of the bowl.

From the foregoing it will be seen that this invention is one well adapted to attain all of the ends and objects hereinabove set forth, together with other advantages which are obvious and which are inherent to the apparatus. p It will be understood that certain features and subcombinations are of utility and may be employed without reference to other features and subcombinations. This is contemplated by and is within the scope of the claims.

As many possible embodiments may be made of the present invention without departing from the scope thereof, it is to be understood that all matter herein set forth or shown in the accompanying drawings is to be interpreted as illustrative and not in a limiting sense.

The invention having been described, what is claimed is:

1. An overshot tool for use in recovering an object from a well bore, comprising a tubular body having an upper end adapted to be connected to the lower end of a pipe string so that the body may be raised and lowered within the well bore, a lower end adapted to move over the object as the body is so lowered, and downwardly and inwardly tapered surfaces on its inner diameter intermediate its upper and lower ends, a cylindrical grapple having downwardly and inwardly tapered surfaces on its outer diameter adapted to seat upon the tapered surfaces of the body, and spirally arranged teeth on its inner diameter, said grapple being split longitudinally and free to move upwardly within the body so as to permit it to expand outwardly for gripping an object of greater diameter than the teeth as the lower end of the body is moved over said object, each of the body and grapple having longitudinal slots extending from each end thereof, and means including tangs carried within the body and extending into the